United States Patent [19]

Reinehr et al.

[11] Patent Number: 4,457,885

[45] Date of Patent: Jul. 3, 1984

[54] PROCESS FOR THE PRODUCTION OF DRY-SPUN HOLLOW POLYACRYLONITRILE FIBERS AND FILAMENTS

[75] Inventors: Ulrich Reinehr; Kurt Bernklau, both of Dormagen, Hans Burghartz, Neuss, Toni Herbertz, Dormagen, Hermann-Josef Junguerdorben, Greuenbroich, all of Fed. Rep. of Germany

[73] Assignee: Bayer Aktiengesellschaft, Leverkusen, Fed. Rep. of Germany

[21] Appl. No.: 461,803

[22] Filed: Jan. 28, 1983

Related U.S. Application Data

[62] Division of Ser. No. 311,493, Oct. 15, 1981, abandoned.

[30] Foreign Application Priority Data

Oct. 30, 1980 [DE] Fed. Rep. of Germany ..... 3040971

[51] Int. Cl.[3] ..... D01F 6/18

[52] U.S. Cl. ..... 264/177 F; 264/209.1; 264/206

[58] Field of Search ..... 264/209.1, 177 F, 182, 264/206

[56] References Cited

U.S. PATENT DOCUMENTS

| | | | |
|---|---|---|---|
| 3,340,571 | 9/1967 | Bishop et al. . | |
| 3,558,420 | 1/1971 | Opfell | 264/177 F |
| 4,085,174 | 4/1978 | Ishikawa et al. . | |
| 4,176,150 | 11/1979 | Bromley et al. | 264/177 F |
| 4,296,175 | 10/1981 | De Maria et al. . | |

FOREIGN PATENT DOCUMENTS

| | | | |
|---|---|---|---|
| 45625 | 4/1966 | Fed. Rep. of Germany | 264/177 F |
| 2804376 | 8/1979 | Fed. Rep. of Germany | 264/177 F |
| 54-2419 | 1/1979 | Japan | 264/177 F |
| 54-6919 | 1/1979 | Japan | 264/177 F |

*Primary Examiner*—Jay H. Woo

*Attorney, Agent, or Firm*—Sprung, Horn, Kramer & Woods

[57] ABSTRACT

Hollow acrylonitrile fibres and filaments are prepared by dry spinning the spinning dope through a nozzle having loop-shaped nozzle orifices, the solution having a viscosity equivalent to at least 120 falling ball seconds, measured at 80° C., or at least 75 falling ball seconds, measured at 100° C., wherein the nozzle orifice area of the profiling nozzle is smaller than 0.2 $mm^2$ and the maximum width of the sides of the loop-shaped nozzle is 0.1 mm and the overlap between the two ends of the sides of the loop-shaped nozzle forms an angle of from 10° to 30° measured from the center of the nozzle and wherein the spinning air acts on the filaments in a transverse direction to the filament take-off and the air direction forms an angle of from 80° to 100° with a straight line passing through the opening between the sides.

9 Claims, 6 Drawing Figures

PROCESS FOR THE PRODUCTION OF DRY-SPUN HOLLOW POLYACRYLONITRILE FIBERS AND FILAMENTS

This is a division of application Ser. No. 311,493, filed Oct. 15, 1981 now abandoned.

BACKGROUND OF THE INVENTION

The production of hollow fibers by melt spinning or wet spinning has long been known. The processes mentioned in numerous patents are based essentially on three approaches.

In the first method, a molten polymer, for example a polyester, is spun from nozzles as adjacent arcuate segments. Synthetic hollow fibers are produced by swelling the molten polymer beneath the nozzle and allowing the edges of the arcuate segments to coalesce into a continuous form. In the second method, a hollow needle positioned in the center of the orifice is used, gaseous substances or fillers being pumped through the hollow needle. The polymer flows round the needle and the gas fills the central void and maintains the form until the polymer has cooled. Hollow viscose filaments, in particular, are produced in this way and castor oil, for example, may be used as lumen-filling medium. Lastly, in the third method, a solid pin is positioned in the nozzle orifice. This is generally a difficult spinning process as the polymer wishes to assume a closed form. The process is particularly suitable for cross-section modifications, but air has to be supplied to the end of the pin or a vacuum has to be applied to produce hollow fibers.

Hollow filaments and fibers have found many applications. Thus, for example, they are used for the desalination of sea water, for the purification of liquids and gases, in ion exchanger, for reverse osmosis, dialysis and ultrafiltration (artificial kidneys) and, because of the low weight and the high bulk thereof, for comfortable clothes. In particular, the purification of substances, for example industrial gases, has recently come to the fore. Comprehensive articles about the production and importance of synthetic hollow fibers may be found in the *Encyclopedia of Polymer Science and Technology,* 15, (1971), Pages 258–272, in *Acta Polymerica,* 30, (1979), Pages 343–347 and in *Chemical Engineering,* February 1980, Pages 54–55.

There have also been numerous attempts to produce hollow acrylic fibers from a spinning solution by a dry spinning process. However, owing to the problems encountered, no commericial process for the production of hollow acrylic fibers by this technique has previously been disclosed.

For the present purposes, the term "hollow fibers" refers to fibers having an internal, linear, continuous longitudinal channel.

Although acrylonitrile polymers may be converted to hollow fibers relatively simply by the wet spinning technique by one of the above-mentioned methods, this leads to considerable difficulties in a dry spinning process owing to a different filament formation mechanism. In a wet spinning process, filament formation is effected by coagulation of the spinning solution in an aqueous precipitating bath containing a solvent for polyacrylonitrile, the precipitating bath concentration, temperature and additional coagulating agent, such as aqueous salt solutions, may be varied within wide limits. Thus, for example, German Offenlegungsschrift No. 2,346,011 describes the production of hollow acrylic fibers by the second wet spinning method using aqueous DMF as precipitating bath and German Offenlegungsschrift No. 2,321,460 uses aqueous nitric acid, the filaments being spun from nozzles having annular orifices and a liquid being introduced into the center of the annular orifice as an internal precipitant.

In attempting to apply the three methods to a dry spinning process, considerable difficulties are encountered as, when spinning from a spinning solution, only a proportion of the solvent has to evaporate after issuing from the nozzle in order for a thread to be formed and solidify. Owing to the high production costs and the difficult process control when producing hollow acrylic fibers by dry spinning from spinning solutions, the second and third methods were not pursued.

When attempting to produce hollow fibers according to the first method using profile nozzles having adjacent segmental arcuate orifices by the dry spinning process, only dumbbell-shaped or irregular random cross-sections are generally obtained which have uneven air inclusions. If the concentration of polymer solids is increased in order to obtain the predetermined cavity profile by increasing the structural viscosity, unexpected problems arise. The increase in the solids content is subject to limits owing to the gelation, flowability and management of the spinning solutions. Thus, for example, an acrylonitrile copolymer having a chemical composition of 93.6% of acrylonitrile, 5.7% of acrylic acid methyl ester and 0.7% of sodium methallyl sulphonate and a K-value of 81 may only be dissolved and spun into threads in a spinning solvent, such as dimethylformamide, to a maximum solids content of 32%, by weight. If an attempt is made to raise further the solids content, and spinning solutions gel during cooling at temperatures of from 50° to 80° C., rendering disturbance-free spinning impossible.

SUMMARY OF THE INVENTION

Owing to the numerous possible applications of these hollow fibers and filaments, an object of the present invention was to propose a dry spinning process of this type for the production of hollow acrylonitrile fibers.

It has now surprisingly been found that hollow polyacrylonitrile filaments may only be spun by a dry spinning process if spinning solutions having a viscosity exceeding a certain value are used, if nozzles having loop-shaped orifices of specific dimensions are used and if the spinning air is allowed to act on the filaments in a specific manner.

The present invention therefore relates to dry-spun hollow polyacrylonitrile filaments. Suitable acrylonitrile polymers for the production of these filaments and fibers obtainable therefrom include acrylonitrile homo- and co-polymers in which the copolymers contain at least 50% by weight, preferably at least 85%, by weight, of polymerized acrylonitrile units.

The present invention also relates to a process for the production of hollow polyacrylonitrile filaments and fibers characterized in that the filament-forming synthetic polymers are spun from a solution through a nozzle having loop-shaped orifices by a dry spinning process wherein the solution has a viscosity equivalent to at least 120 falling ball seconds, measured at 80° C., or at least 75 falling ball seconds, measured at 100° C., wherein the area of the orifice is less than 0.2 $mm^2$, the sides of the loop-shaped orifice are a maximum of 0.1 mm apart and the overlap of the two ends of the sides of the loop-shaped orifice forms an angle of from 10° to 30° measured from the center of the nozzle and wherein the spinning air acts on the filaments in a transverse direction to the filament take-off and the air direction forms an angle of from 80° to 100° with a straight line passing through the opening in the sides.

The other conventional steps of the polyacrylonitrile dry spinning process follow the spinning operation.

DETAILED DESCRIPTION OF THE INVENTION

Figure 1:
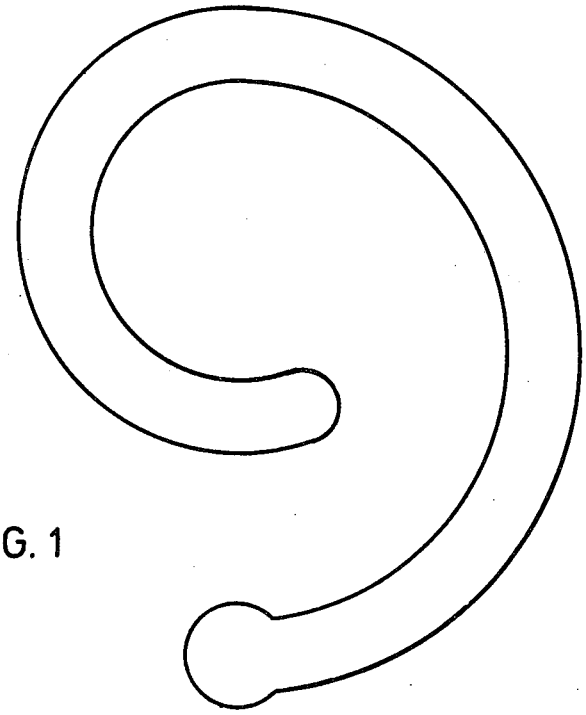
FIG. 1 is an elevational view of a spiral or loop-shaped nozzle orifice for use in the present invention wherein the overlap angle of the two ends of the sides is about 20°.

The viscosity in falling ball seconds, measured at 80° and 100° C., was determined by K. Jost's method, *Reologica Acta,* Volume 1 (1958), Page 303. The area of the nozzle orifice is preferably less than 0.1 $mm^2$ and the side has a width of between 0.02 and 0.06 mm. Merging of the cross-sectional shape is observed in the case of nozzle orifice areas exceeding 0.2 $mm^2$. Indefinite nodular to formlessly deformed, random configurations are obtained.

Spinning solutions having the specified viscosity which also contain a higher concentration of the filament-forming polymer than normally used are obtained, according to German Offenlegungsschrift No . 2,706,032, by producing suitably concentrated suspensions of the filament-forming polymer, which may easily be conveyed, in the desired solvent and by converting these suspensions into spinning solutions which are viscosity stable by briefly heating them to temperatures just below the boiling point of the spinning solvents used.

The suspensions for the production of these spinning solutions are obtained by reacting the spinning solvent with a non-solvent for the polymer to be spun, if necessary, and then adding the polyer with stirring.

"Non-solvents" in the context of the present invention include all substances which are non-solvents for the polymer and which may be mixed with the spinning solvent within wide limits.

The boiling points of the non-solvents may lie below, as well as above the boiling point of the spinning solvent used. Substances of this type which may be solid or liquid include, for example, alcohols, esters or ketones, as well as singly- and multiply-substituted alkyl ethers and esters of polyhydric alcohols, inorganic or organic acids, salts and the like. As preferred non-solvents, there are used, on the one hand, water, owing to its simple management, simple removal in the spinning duct without the formation of a residue and simple recovery, and, on the other hand, glycerin, mono- and tetra-ethylene glycol, as well as sugar.

When using non-solvents having boiling points below the boiling point of the spinning solvent, hollow acrylic fibers are obtained which are distinguished from the known compact types by a considerably greater water-retention capacity. When using non-solvents whose boiling point lies above that of the spinning solvent, acrylic fibers having a high water-retention capacity are obtained, as described in German Offenlegungsschrift No. 2,554,124. These fibers are distinguished by particular wear properties. While the non-solvent is removed in the spinning duct in the first case, the non-solvent has to be washed from the solidified fiber in an additional stage of the process after the spinning process in the second case.

When using water as a non-solvent, hollow fibers may be obtained from the nozzles by the dry spinning process by using the acrylonitrile copolymer mentioned above having a K value of 81 and a solids content in the spinning solution of 36%, by weight.

The water content of these suspensions of polyacrylonitrile and dimethylformamide is between 2 and 10%, based on the total suspension. With a water addition of less than 2%, by weight, a flowable transportable suspension is not obtained, but rather a thick inert slurry. On the other hand, if the water content exceeds 10%, by weight, the filaments disintegrate beneath the nozzle during the spinning process owing to the high water vapor partial pressure as they issue from the nozzle orifices. The percentage of water in the spinning solution does not influence the profiling at the nozzle. The only decisive factor is the concentration of polymer solids. Water contents of from 2 to 3% have proved to be optimal with solids contents of up to 40% in order still to obtain flowable transportable suspensions at room temperature. If another non-solvent such as propanol or butanol, is used instead of water, the same results are obtained. More highly concentrated spinning solutions may obviously also be produced for acrylonitrile copolymers having K values below 81. Thus, for example, it is possible to produce from an acrylonitrile copolymer of 92% of acrylonitrile, 6% of acrylic acid methyl ester and 2% of sodium methallyl sulphonate having a K value of 60, a suspension comprising 45% of copolymer solids content, 4% of water and 51% of dimethylformamide having a viscosity equivalent to 142 falling ball seconds, measured at 80° C., which is still flowable at room temperature and may be converted into hollow fibers by dissolution and spinning from a particular profiled nozzle. On the other hand, hollow fibers may be obtained when using polymers having higher K values, even at a lower solids concentration than the specified 36% spinning solutions having a K value of 81 during dry spinning from certain profiled nozzles. The only decisive factor for the shaping at the profiled nozzle is the viscosity.

When using monoethylene glycol as non-solvent, using the acrylonitrile copolymer mentioned above, spinning solutions having solids contents of 36%, by weight, or higher could be produced, the viscosities of which were equivalent to at least 75 falling ball seconds, measured at 100° C. From these spinning solutions, hollow filaments and fibers were spun which were distinguished by the high water-retention capacity thereof after washing out the non-solvent and after the conventional subsequent treatment. The non-solvent content of these suspensions of polyacrylonitrile, dimethylformamide and monoethylene glycol must be at least 5%, by weight, based on solvent and solid, as indicated in German Offenlegungsschrift No. 2,554,124, so that the filaments and fibers have a water-retention capacity of at least 10%. As shown in Table II, the percentage content of non-solvent in the spinning solution does not influence the profiling at the nozzle. The fact that the spinning solution has a minimum viscosity is far more decisive. In the case of solids contents of up to 40%, by weight, non-solvent contents of from 5 to 10%, by weight, have proven to be preferred in order to obtain hollow acrylic fibers having a water-retention capacity exceeding 10%. The solid composition surrounding the internal, linear continuous channel in the fiber has a core/sheath structure. The thickness of the fiber sheath may be varied within wide limits by the ratio of the polymer solid to the non-solvent content. In accordance with the statements concerning the use of water as non-solvent it is also found that, when using non-solvents whose boiling point exceeds the boiling point of the spinning solvent, acrylonitrile copolymers having K values below 81 produce the required minimum viscosity in the spinning solution in a higher concentration and acrylonitrile copolymers having K values exceeding 81 in a lower concentration.

The minimum viscosity may be determined at two different temperatures, namely at 80° C. and 100° C. This feature takes into account the fact that it is difficult to determine the viscosity in spinning solutions containing water as non-solvent owing to the vaporization of the water at 100° C., while it may be problematic to determine the viscosity in other spinning solutions containing as non-solvent a substance whose boiling point exceeds that of the spinning solvent at 80° C. owing to the gelation tendency. However, the viscosity of water-containing spinning solutions may also be determined at 100° C. if the process is carried out in a closed system.

Providing that the spinning solution to be spun produces a finite falling ball second value, it is basically possible to produce hollow acrylic fibers from that spinning solution. However, spinning solutions having viscosities exceeding the equivalent of 300 falling ball seconds, measured at 80° C. or 100° C. cannot be processed without difficulty in conventional spinning apparatus for economic reasons, thus producing a natural upper limit for the viscosity range.

Suitable spinning solvents include, in addition to dimethylformamide, even higher boiling solvents, such as dimethylacetamide, dimethylsulphoxide, ethylene carbonate and N-methylpyrrolidone and the like.

Figure 3:
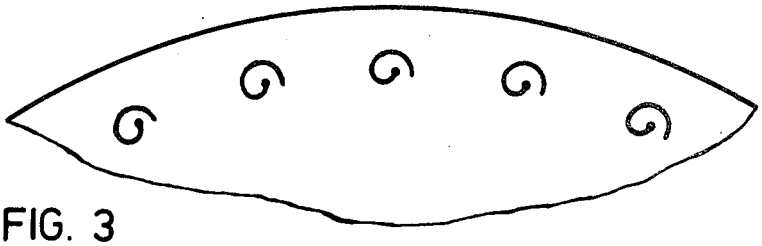
FIG. 3 is a partial view of a nozzle showing a plurality of nozzle orifices wherein the air enters the openings between the sides directly—the opening between the sides of the nozzle holes has a different position from the transverse position to the center of the spinning duct.
Figure 4:
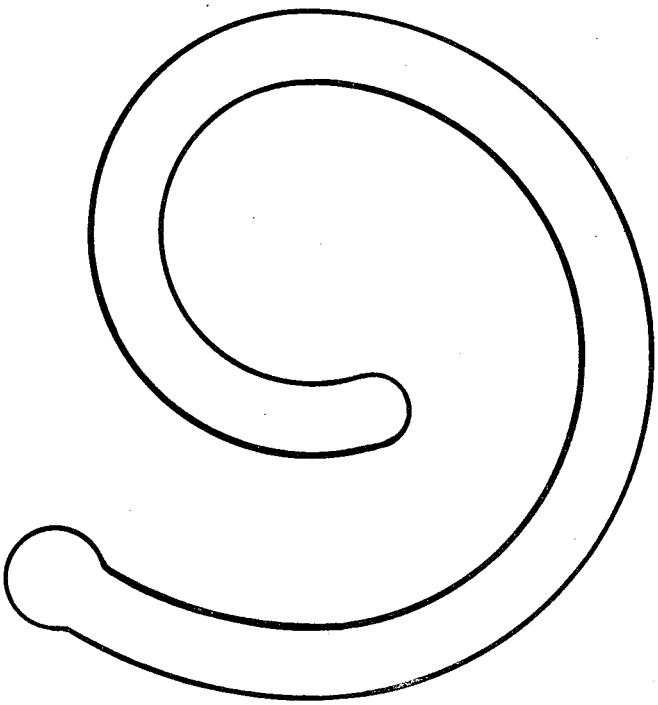
FIG. 4 is an elevational view of a spiral or loop-shaped nozzle orifice wherein the overlap angle of the two ends of the sides is 55°.

The process control of the spinning air during filament formation, as well as the particular geometry, size and arrangement of the nozzle orifices in the spinnerettes suitable for the production of hollow acrylic, fibers represent other important factors in the production of hollow acrylic fibers by a dry spinning process according to the present invention. It has been found that, to produce round hollow-fibers which are uniform in shape and have cavity portions which are equal to each other, a spiral or loop-shaped nozzle according to accompanying FIG. 1 is particularly advantageous, the overlap angle of the two ends of the sides of the spiral nozzle holes being from 10° to 30°, preferably 20°. If the end of the side of the spiral nozzle orifices is lengthened, the overlap angle of the two ends of the sides is 55° for example (cf. accompanying FIG. 4) or if the opening between the sides of the spiral nozzle holes has a different position from the transverse position to the center of the spinning duct (cf. accompanying FIG. 3), then hollow fibers which are uniform in shape and cavity portion are not obtained. Depending on the spinnerette geometry and arrangement of the opening between the sides relative to the centre of the spinning duct, kidney-shaped and other undesirable cross-sectional shapes are formed. In addition to this particular nozzle orifice geometry and arrangement, the method of air supply to the profiled filaments plays an important part in the formation of hollow fibers. Uniform hollow fibers are obtained only by intentionally blowing spinning air from the center of the spinning duct onto the filaments. If the air is applied to the filaments in a different manner, for example from the interior and exterior, indefinite random fiber cross-sections having varying cavity portions are obtained. It is obviously important for the spinning air not to impinge centrally upon the openings of the sides of the profiling nozzle, but to enter in a transverse direction at an angle of from 80° to 100°, preferably 90° (cf. accompanying FIG. 2). If the spinning air enters the openings between the sides directly (cf. accompanying FIG. 3) the filaments swell to a marked extent and then deflate under the influence of the drawing operation. Non-uniform cross-sectional shapes and variable cavity portions are obtained.

In addition to the particular process control of the spinning air during filament formation, as well as the particular geometry and arrangement of the nozzle orifices of the profiling nozzle to be used, the diameter of the nozzle orifice and the nozzle orifice area play an important part, as mentioned. It has been found that, in the case of certain geometrical configurations, filament cross-sections having sharp contours may only be spun up to a specific width of the sides depending on the total nozzle orifice area. The term "width of the side of a profiling nozzle" refers to the distance between the outer limit of the predetermined profile shape in mm, but not the distance to the center of the nozzle orifice.

In addition to the above-mentioned properties for dialysis and ultrafiltration purposes, the fibers according to the present invention are distinguished, in particular, by the high water-retention capacity thereof. Textile sheets made of these fibers have good comfort in wear, as mentioned in German Offenlegungsschrift No. 2,719,019. The water-retention capacity is at least 10% whenever there is a closed, uniform hollow fiber having a constant cavity portion. Varying values for the water-retention capacity are found in the case of non-uniform hollow fiber cross-sectional shapes, as well as partially open, partially closed shapes, depending on the cavity portion. The water-retention capacity is determined in accordance with the DIN regulation 53 814 (cf. *Melliand Textilberichte,* 4, 1973, page 350).

The fiber samples are immersed for two hours in water containing 0.1% of wetting agent. The fibers are then centrifuged for ten minutes at an acceleration of 10,000 m/sec$^2$ and the quantity of water retained in and between the fibers is determined by gravimetric analysis. To determine the dry weight, the fibers are dried at 105° C. to constant weight. The water-retention capacity (WR) in percent, by weight, is:

$$WR = \frac{m_f - m_{tr}}{m_{tr}} \times 100$$

$m_f$=weight of the moist fiber material
$m_{tr}$=weight of the dry fiber material The cross-sections of such hollow fibers tend to deform under stress of high temperatures owing to the structure thereof. If, for example, a continuous hollow cable is dried at temperatures above 160° C., individual hollow capillaries break open, forming irregular, partially open fiber cross-sections and high proportions of short fibers. The following after-treatment procedure has been found to be the best for the subsequent treatment of the fibers according to the present invention: washing-drawing-preparation-crimping-cutting-drying to a maximum of 140° C. A drying temperature of from 110° to 130° C. is preferred. If the hollow acrylic fibers according to the present invention are subjected to an after-treatment, as just mentioned, closed, uniform hollow fibers having uniform cavity portions are obtained.

EXAMPLE 1

59 Kg of dimethylformamide (DMF) are mixed with 3 kg of water in a heated chamber at room temperature with stirring. 38 kg of an acrylonitrile copolymer composed of 93.6% of acrylonitrile, 5.7% of acrylic acid methyl ester and 0.7% of sodium methallyl sulphonate having a K value of 81 are then added at room temperature with stirring. The suspension is pumped via a gear pump into a heated spinning chamber provided with a stirrer. The suspension, which has a solids content of 38%, by weight, and a water content of 3%, by weight, based on total solution, is then heated in a double-walled tube using steam at 4.0 bar. The residence time in the tube is seven minutes. The temperature of the solution at the tube outlet is 138° C. The tube contains several mixing chambers for the homogenization of the spinning solution. The spinning solution, which has a viscosity equivalent to 176 falling ball seconds at 90° C., is filtered after leaving the heating apparatus without intermediate cooling and is supplied directly to the spinning duct.

The spinning solution is dry spun from a 36-orifice nozzle having spiral nozzle orifices (cf. accompanying FIG. 1). The nozzle orifices are arranged round an annular nozzle in such a way that the openings of the profiled nozzle are orientated transversely to the air jet (cf. accompanying FIG. 2). The nozzle orifices have an area of 0.08 $mm^2$ and the width of the sides is 0.06 mm. The duct is at a temperature of 160° C. and the air at a temperature of 150° C. The quantity of air passed through, which issues in the immediate vicinity of the spinnerette onto the filament bundle issuing from the spinnerette in a transverse direction to the filament take-off at one end from the center of the spinnerette in all directions, is 30 $m^3$/h. The take-off speed is 125 m/min. The spun material having a titer of 790 dtex is collected on bobbins and twisted into a tow having a total titer of 158 000 dtex. The fiber cable is then washed in water at 80° C., drawn 1:4 in boiling water, provided with an antistatic preparation, crimped, cut into staple fibers having a length of 60 mm and subsequently dried on a perforated belt drier at 120° C. The hollow fibers which have a final titer of 6.7 dtex have a tensile strength of 2.7 cN/tex and a breaking elongation of 31%. The water-retention capacity is 37.6%. For microscopic examination of the cross-sectional geometry, the fiber capillaries were imbedded in methacrylic acid methyl ester and cut transversely. The light-microscopic photographs produced by the differential interference contrast method shown that the cross-sections of the samples had a complete, uniform round cavity structure. The cavity portion formed about 50% of the total cross-sectional area.

Table 1 below shows the limits to the process according to the present invention for the production of hollow acrylic fibers by the dry spinning proces, with reference to further Examples. In all cases, an acrylonitrile copolymer having the chemical composition from Example 1 is again used and converted into a spinning solution in the manner described therein. The solids content, as well as the type and proportion of non-solvent for polyacrylonitrile were varied. A loop-shaped 36-orifice nozzle (cf. accompanying FIG. 1) with the orifice arrangement indicated in accompanying FIG. 2 was used for spinning. The spinning and after-treatment conditions correspond to the data given in Example 1. The viscosities were measured in falling ball seconds at 80° C.

TABLE I

| No. | Non-solvent for PAN | Visc. (falling ball sec) at 80° C. | Chemical composition % of spinning solution PAN | non-solvent | DMF | Fiber cross-section | Contour sharpness |
|---|---|---|---|---|---|---|---|
| 1 | Water | 41 | 34 | 3 | 63 | Kidney-shape | No hollow fiber |
| 2 | Water | 73 | 35 | 3 | 62 | Hollow fiber + kidney-shape | No hollow fiber |
| 3 | Water | 120 | 36 | 3 | 61 | Hollow fiber | in order |
| 4 | Water | 176 | 38 | 3 | 59 | Hollow fiber | in order |
| 5 | Water | 243 | 40 | 3 | 57 | Hollow fiber | in order |
| 6 | Water | 75 | 35 | 4 | 61 | Hollow fiber + kidney-shape | No hollow fiber |
| 7 | Water | 79 | 35 | 5 | 60 | Hollow fiber + kidney-shape | No hollow fiber |
| 8 | Water | 124 | 36 | 4 | 60 | Hollow fiber | in order |
| 9 | Water | 105 | 30 | 10 | 60 | No spinning possible - breaking of the filaments. | — |
| 10 | Butanol | 106 | 35 | 4 | 61 | Hollow fiber + kidney-shape | No hollow fiber |
| 11 | Butanol | 127 | 36 | 4 | 60 | Hollow fiber | in order |
| 12 | Butanol | 233 | 38 | 4 | 58 | Hollow fiber | in order |

EXAMPLE 2

(a) A proportion of the spinning solution from Example 1 is dry spun in the manner described therein from a 36-orifice nozzle having loop-shaped nozzle orifices (cf. accompanying FIGS. 1 and 2) under spinning conditions which are identical, except that the spinning air passed through at 30 $m^3/h$ may act on the filament bundle issuing from the spinnerette in the direction of the filament take-off in the immediate vicinity of the spinnerette from the outside, as well as from the inside. The spun material is collected on bobbins and, as described in Example 1, is twisted into a tow having a total titer of 158 000 dtex and is subsequently treated to form fibers having a final titer of 6.7 dtex. The cross-sections of the fiber sample do not have a uniform shape and have varying cavity portions, About 50% of the fiber cross sections are completely compact.

Figure 2:
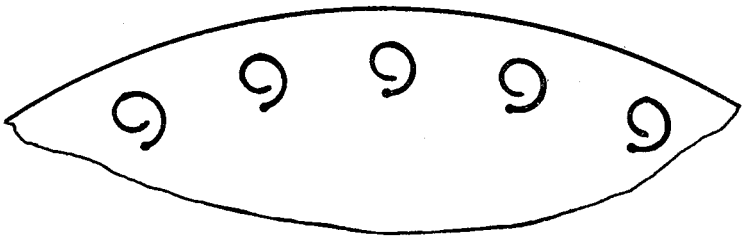
FIG. 2 is a partial view of an annular nozzle for use in the present invention showing a plurality of nozzle orifices as depicted in FIG. 1 wherein the openings of the nozzle are oriented in a transverse direction to the air jet.

(b) A further proportion of the spinning solution from Example 1 is dry spun in the manner described therein from a 36-orifice nozzle having loop-shaped nozzle orifices according to accompanying FIGS. 1 and 2, under spinning conditions which are identical except that the spinning air passed through at 30 $m^3/h$ may act on the issuing filament bundle in the immediate vicinity of the spinnerette in the transverse direction from the outside instead of from the inside. Spun material is again collected as described in Example 1, twisted and subsequently treated to form fibers having a final titer of 6.7 dtex. The cross-sections of the fiber sample again do not have a uniform shape and have varying cavity portions. About 60% of the fiber cross-sections were completely compact.

EXAMPLE 3

A proportion of the twisted hollow fiber cable from Example 1 having a total titer of 158 000 dtex was washed in water at 80° C., drawn 1:4 in boiling water, provided with an antistatic preparation and dried under tension at 160° C. in a drum drier. The filaments were then crimped and cut into staple fibers having a length of 60 mm. The hollow fibers which have a final titer of 6.7 dtex, have a water-retention capacity of 14.1%. The cross-sections of the fibre samples comprise, in addition to about 30% of round hollow fibers which are uniform in shape, about 70% of fibers which are deflated in shape having varying cavity portions, for example half-moon-shaped to sickle-shaped configurations, as well as hollow fibres having several breakages in cross-section. A super-pressure is obviously formed in the air enclosed in the cavity when drying hollow fiber cables at high temperatures, so that the hollow fibers break open with collapse of the cross-sectional structure. The breaking of the hollow fibers is demonstrated in the drier by grating noises.

EXAMPLE 4

An acrylonitrile copolymer having the chemical composition from Example 1, was dissolved, filtered and dry spun from a 36 orifice nozzle having spiral nozzle orifices (cf. accompanying FIG. 3) in the manner described therein. In contrast to Example 1, however, the nozzle orifices are arranged in such a way that the opening between the sides is orientated exactly toward the center of the spinning duct so that the spinning air may enter the spinning orifices centrally from the center of the spinning duct (air jet angle=0°). The overlap between the ends of the sides of the nozzle orifices is again 20°, the nozzle orifice area 0.08 $mm^2$ and the width of the sides 0.06 mm. The other spinning and after-treatment data correspond to the particulars in Example 1. The hollow fibers, which have a final titer of 6.7 dtex, have a water-retention capacity of 16.4%. The cross-sections of the fiber samples reveal irregularly deformed tubular to loop-shaped collapsed hollow fibers having varying cavity portions, as well as some completely compact structures.

EXAMPLE 5

Figure 5:
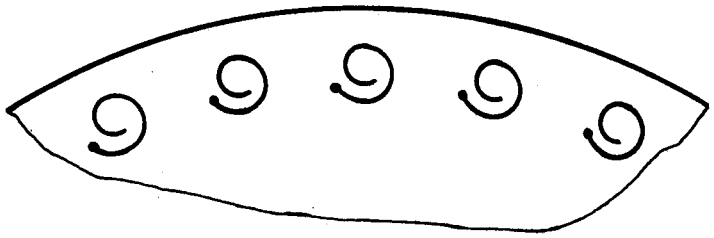
FIG. 5 is a partial view of a nozzle showing a plurality of nozzle orifices wherein the air flows at an angle of about 125°.

An acrylonitrile copolymer having the chemical composition from Example 1 was dissolved, filtered and dry spun from a 36-orifice nozzle having loop-shaped nozzle orifices (cf. accompanying FIG. 4) in the manner described therein. One end of the sides of the loop-shaped nozzle orifices is lengthened in comparison with the profiling nozzle from Example 1 in such a way that the overlap angle of the ends of the sides is 55°, so that the air no longer flows transversely to the openings between the sides of the profiling nozzle, but at an angle of 125° (cf. accompanying FIG. 5). The nozzle orifices have an area of 0.095 $mm^2$ and the width of the sides is 0.06 mm. The other spinning and after-treatment conditions correspond to the particulars in Example 1. The fibers, which have a final titer of 6.7 dtex, have a water retention capacity of 10.7%. The cross-sections of the fiber sample do not exhibit a closed cavity shape but have half-moon-shaped to curved configurations.

EXAMPLE 6

Figure 6:
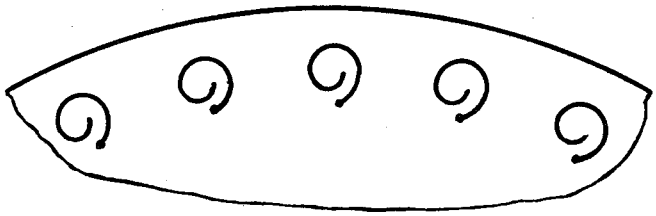
FIG. 6 is a partial view of a nozzle showing a plurality of nozzle orifices wherein the opening between the ends of the nozzle form an angle of about 35° to the direction of the air from the center of the spinning duct.

An acrylonitrile copolymer having the chemical composition from Example 1, was dissolved, filtered and dry spun from a 36 orifice nozzle having loop-shaped nozzle orifices (cf. accompanying FIG. 3) in the manner described therein. One end of the sides of the loop-shaped nozzle orifices is lengthened in the manner described in Example 5 in such a way that the overlap angle of the ends of the sides is 55°. In contrast to Example 5, however, the nozzle orifices are arranged in such a way that the openings between the ends of the sides of the profiling nozzle form an angle of 35° to the direction of the spinning air from the center of the spinning duct so that the spinning air may only flow obliquely into the nozzle orifices from the inside (cf. accompanying FIG. 6). The area of the nozzle orifices is 0.095 $mm^2$ and the width of the sides 0.06 mm. The other spinning and after-treatment conditions correspond to the particulars in Example 1. The hollow fibers, which have a final titer of 6.7 dtex, have a water retention capacity of 20.5%. The cross-sections of the sample fibers exhibit predominantly closed tubular to loop-shaped configurations which are, however, irregularly deformed.

EXAMPLE 7

(a) An acrylonitrile copolymer having the chemical composition from Example 1 was dissolved, filtered and dry spun from a 36-orifice nozzle having loop-shaped nozzle orifices (cf. accompanying FIG. 1) in the manner described therein. The nozzle orifice arrangement and the overlap angle between the two ends of the sides correspond to the particulars in Example 1 so that the air flow angle between the center of the spinning duct and the profiling nozzle opening is again 90°. In contrast to Example 1, the width between the sides of the profiling nozzle is 0.10 mm instead of 0.06 mm and the nozzle orifice area is 1.33 $mm^2$. The other spinning and after-treatment conditions correspond to the particulars in Example 1. The hollow fibers, which have a final titer of 6.7 dtex, have a water-retention capacity of 35.3%. The cross-sections of the sample fibers are completely uniform and round and the cavity portion again forms about 50% of the total cross-sectional area.

(b) A proportion of the spinning solution from Example 7 is dry spun from a 36 orifice nozzle having loop-shaped nozzle orifices (cf. accompanying FIG. 1) as described in Example 1. The nozzle orifice arrangement, overlap angle of the ends of the sides and the air flow angle again correspond to the particulars in Example 1. The width of the sides of the profiling nozzle is 0.12 mm and the nozzle orifice area 0.16 $mm^2$. The spinning and after-treatment conditions correspond to the data in Example 1. However, hollow fibers which are not uniform in shape are formed. In addition to completely round hollow fibers, loop-shaped forms and collapsed cross-sectional shapes having a tubular smaller volume cavity are also obtained. The water-retention capacity is 23.1%.

(c) A further proportion of the spinning solution from Example 7 is dry spun from a 36 orifice nozzle having loop-shaped nozzle orifices (cf. accompanying FIG. 1) as described in Example 1. The arrangement of nozzle orifices, overlap angle and air flow angle correspond to the particulars from Example 1. The width of the sides of the profiling nozzle is 0.15 mm and the nozzle orifice area 0.20 $mm^2$. The spinning and after-treatment conditions correspond to the data in Example 1. Hollow fibers are no longer obtained. The profile shape merges, forming compact, irregular oval or irregular cross-sectional structures. The water-retention capacity is 6.3%.

EXAMPLE 8

51 kg of DMF are mixed with 4 kg of water in a heated chamber with stirring. 45 kg of an acrylonitrile copolymer containing 92% of acrylonitrile, 6% acrylic acid methyl ester and 2% of sodium methallyl sulphonate having a K value of 60 are then added at room temperature with stirring. The suspension, which has a solids content of 45%, is dissolved, filtered and dry spun from a loop-shaped profiling nozzle having 36 orifices according to accompanying FIGS. 1 and 2 in the manner described in Example 1. The viscosity of the spinning solution is equivalent to 142 falling ball seconds at 80° C. The other spinning and after-treatment conditions correspond to the statements in Example 1. The cross-sections of the sample hollow fibers, which have a final titer of 8.0 dtex, exhibit a completely uniform round profile having a cavity portion of about 50%. The water-retention capacity is 39%.

EXAMPLE 9

57 kg of dimethylformamide (DMF) are mixed with 6 kg of monoethylene glycol in a heated chamber at room temperature with stirring. 37 kg of an acrylonitrile copolymer containing 93.6% of acrylonitrile, 5.7% of acrylic acid methyl ester and 0.7% of sodium methallyl sulphonate having a K value of 81 are then added at room temperature with stirring. The suspension is pumped via a gear pump into a heated spinning chamber provided with a stirrer. The suspension, which has a solids content of 37%, by weight, is then heated in a double-walled tube using steam at 4.0 bar. The residence time in the tube is 7 minutes. The temperature of the solution at the tube outlet is 138° C. The tube contains several mixing chambers for the homogenization of the spinning solution. The spinning solution, which has a viscosity equivalent to 186 falling ball seconds at 100° C., is filtered after leaving the heating apparatus without intermediate cooling and is supplied directly to the spinning duct.

The spinning solution is dry spun from a 36 orifice nozzle having spiral nozzle orifices (cf. accompanying FIG. 1). The nozzle orifices are arranged over an annular nozzle in such a way that the openings of the profiling nozzles are orientated transversely to the air flow (see accompanying FIG. 2). The nozzle orifice area is 0.08 $mm^2$ and the width of the sides 0.06 mm. The duct temperature is 160° C. and the air temperature 150° C. The quantity of air passed through, which issues in the immediate vicinity of the spinnerette onto the filament bundle issuing from the spinnerette in a transverse direction to the filament take-off at one end from the center of the spinning duct in all directions, is 30 $m^3/h$. The take-off speed is 125 m/min. The spun material having a titer of 790 dtex is collected on bobbins and twisted into a tow having a total titre of 158 000 dtex. The fiber cable is then washed in water at 80° C., drawn 1:4 in boiling water, provided with an antistatic preparation, crimped, cut into staple fibers having a length of 60 mm and subsequently dried on a perforated belt drier at 120° C. The hollow fibers, which have a final titer of 6.7 dtex, have a tensile strength of 2.3 cN/tex and a breaking elongation of 37%. The water-retention capacity is 50.3%. The cross-sections of the samples have a complete, uniform round cavity structure. The cavity portion amounts to about 50% of the total cross-sectional area. The solid composition surrounding the cavity consists of a porous core/sheath structure.

The limits of the process according to the present invention for the production of hollow acrylic fibers by the dry spinning process are indicated in Table II below with reference to further Examples. In all cases, an acrylonitrile copolymer having the chemical composition in Example 9 is again used and is converted into a spinning solution in the manner described therein. The solids concentration, as well as the type and proportion of non-solvent for polyacrylonitrile were varied. A 36 orifice nozzle having a loop-shape (cf. accompanying FIG. 1) with the orifice arrangement indicated in accompanying FIG. 2 was used for spinning. The spinning and after-treatment conditions correspond to the particulars from Example 9. The viscosities were measured in falling ball seconds at 100° C. in the manner described above.

TABLE II

| No. | Non-solvent for PAN | Chemical composition of the spinning solution % PAN | non-solvent | DMF | WR % | Viscosity (falling ball sec.) at 100° C. | Fiber cross-section |
|---|---|---|---|---|---|---|---|
| 1 | Tetraethylene glycol | 38 | 7 | 55 | 35.3 | 152 | Round hollow shape with core/sheath structure |
| 2 | Tetraethylene glycol | 36 | 7 | 57 | 42.1 | 100 | Round hollow shape with core/sheath |

TABLE II-continued

| No. | Non-solvent for PAN | Chemical composition of the spinning solution % PAN | non-solvent | DMF | WR % | Viscosity (falling ball sec.) at 100° C. | Fiber cross-section |
|---|---|---|---|---|---|---|---|
| | | | | | | | structure |
| 3 | Tetraethylene glycol | 35 | 7 | 58 | 27.4 | 72 | oval, 80% hollow fiber; 20% compact |
| 4 | Tetraethylene glycol | 34 | 7 | 59 | 19.3 | 58 | oval, 30% hollow fiber; 70% compact |
| 5 | Tetraethylene glycol | 38 | 5 | 57 | 22.7 | 134 | round hollow shape with core/sheath structure |
| 6 | Tetraethylene glycol | 36 | 5 | 59 | 26.8 | 87 | round hollow shape with core/sheath structure |
| 7 | Tetraethylene glycol | 36 | 4 | 60 | 17.6 | 78 | round hollow shape, indefinite core/ sheath structure |
| 8 | Tetraethylene glycol | 35 | 3 | 62 | 11.9 | 55 | oval, 40% hollow fiber, 60% compact |
| 9 | Tetraethylene glycol | 36 | 10 | 54 | 55.2 | 184 | round hollow shape with core/sheath structure |
| 10 | Tetraethylene glycol | 34 | 4 | 62 | 13.9 | 48 | irregular to oval, 30% hollow fiber, 70% compact |
| 11 | Tetraethylene glycol | 34 | 5 | 61 | 17.2 | 50 | irregular to oval, 30% hollow fiber, 70% compact |
| 12 | Tetraethylene glycol | 34 | 6 | 60 | 15.4 | 61 | irregular to oval 30% hollow fiber 70% compact |
| 13 | Monoethylene glycol | 34 | 5 | 61 | 16.6 | 70 | irregular to oval 30% hollow fiber 70% compact |
| 14 | Monoethylene glycol | 36 | 8 | 56 | 44.4 | 156 | round hollow fiber with core/sheath structure |
| 15 | Glycerin | 36 | 8 | 56 | 39.3 | 168 | round hollow fiber with core/sheath structure |

EXAMPLE 10

(a) A proportion of the spinning solution from Example 9 is dry spun from a 36 orifice nozzle having loop-shaped nozzle orifices (cf. accompanying FIGS. 1 and 2) in the manner described therein, under identical spinning conditions, except that the spinning air passed through at 30 $m^3/h$ may act on the filament bundle issuing from the spinnerette in the direction of the filament take-off in the immediate vicinity of the spinnerette both from the outside and the inside. The spun material is collected on bobbins and twisted into a tow having a total titer of 158 000 dtex in the manner described in Example 9 and is subsequently treated to form fibers having a final titer of 6.7 dtex. The cross-sections of the sample fibers do not exhibit a uniform shape and have varying cavity portions. About 50% of the fiber cross-sections are completely compact.

(b) A further proportion of the spinning solution from Example 9 is dry spun from a 36 orifice nozzle having loop-shaped nozzle orifices according to accompanying FIGS. 1 and 2 in the manner described therein, under identical spinning conditions, except that the spinning air passed through at 30 $m^3/h$ may act on the issuing filament bundle in the immediate vicinity of the spinnerette in a transverse direction from the outside instead of from the inside. The spun material is again collected, twisted and subsequently treated to form fibers having a final titer of 6.7 dtex as described in Example 9. The cross-sections of the sample fibers again do not exhibit a uniform shape and have varying cavity portions. About 60% of the fiber cross-sections are completely compact.

EXAMPLE 11

A proportion of the twisted hollow fiber cable from Example 9 having a total titer of 158 000 dtex was washed in water at 80° C., drawn 1:4 in boiling water, provided with an antistatic preparation and dried under tension at 160° C. in a drum drier. The filaments were then crimped and cut to staple fibers having a length of 60 mm. The hollow fibers, which have a final titer of 6.7 dtex, have a water-retention capacity of 17.1%. The cross-sections of the sample fibers exhibit, in addition to about 30% of round hollow fibers which are uniform in shape, about 70% of collapsed fibers having varying cavity portions, some half-moon-shaped to sickle-shaped configurations, as well as hollow fibers with several breakages in cross-section. A super pressure is obviously formed in the air enclosed in the cavity when drying this hollow fiber cable at high temperatures, so that the hollow fibers break open and the cross-sectional structure collapses. The breaking open of the hollow fibers is demonstrated in the drier by grating noises. The core-sheath structure is also substantially lost. There are now only compact hollow fibers without a pore system.

EXAMPLE 12

An acrylonitrile copolymer having the chemical composition from Example 9 was dissolved, filtered and dry spun from a 36 orifice nozzle having spiral nozzle orifices (cf. accompanying FIG. 1) in the manner described therein. In contrast to Example 9, however, the nozzle orifices are arranged in such a way that the opening between the sides is orientated exactly toward the center of the spinning duct (cf. accompanying FIG. 3) so that the spinning air may flow into the nozzle openings centrally from the center of the spinning duct (air flow angle equals 0°). The overlap between the ends of the sides of the nozzle orifices is again 20°, the nozzle orifice area 0.08 $mm^2$ and the width of the sides 0.06 mm. The other spinning and after-treatment data correspond to the particulars in Example 9. The hollow fibers, which have a final titre of 6.7 dtex, have a water-retention capacity of 22.4%. The cross-sections of the sample fibers exhibit irregularly deformed tubular to loop-shaped collapsed hollow fibers having varying cavity portions, as well as some completely compact cross-sectional structures.

EXAMPLE 13

An acrylonitrile copolymer having the chemical composition from Example 9 was dissolved, filtered and dry spun from a 36 orifice nozzle having loop-shaped nozzle orifices (cf. accompanying FIG. 4) in the manner described therein. One end of the sides of the loop-shaped nozzle orifices is lengthened in comparison with the profiling nozzle from Example 1 in such a way that the overlap angle between the ends of the sides is 55° so that the air no longer flows transversely to the openings between the sides of the profiling nozzle, but at an angle of 125° C. (cf accompanying FIG. 5). The area of the nozzle orifices is 0.095 $mm^2$ and the width of the sides 0.06 mm. The other spinning and after-treatment conditions correspond to the particulars from Example 9. The fibers, which have a final titer of 6.7 dtex, have a water-retention capacity of 13.7%. The cross-sections of the sample fibers do not exhibit a closed cavity shape, but rather a half-moon-shaped to curved configuration.

EXAMPLE 14

An acrylonitrile copolymer having the chemical composition from Example 9 was dissolved, filtered and dry spun from a 36 orifice nozzle having loop-shaped nozzle orifices (cf. accompanying FIG. 4) in the manner described therein. One end of the sides of the loop-shaped nozzle orifices is lengthened in the manner described in Example 13 so that the overlap angle of the ends of the sides is 55°. In contrast to Example 13, however, the nozzle orifices are arranged in such a way that the openings between the ends of the sides of the profiling nozzle form an angle of 35° to the direction of the spinning air from the center of the spinning duct (cf. accompanying FIG. 6), so that the spinning air may also flow obliquely into the nozzle openings from the inside. The area of the nozzle orifices is 0.095 $mm^2$ and the width of the sides 0.06 mm. The other spinning and after-treatment conditions correspond to the particulars in Example 9. The hollow fibers, which have a final titer of 6.7 dtex, have a water-retention capacity of 24.5%. The cross-sections of the sample fibers exhibit predominantly closed tubular to loop-shaped configurations which are, however, irregularly deformed in structure and have core/sheath structures.

EXAMPLE 15

(a) An acrylonitrile copolymer having the chemical composition from Example 9 was dissolved, filtered and dry spun from a 36 orifice nozzle having loop-shaped nozzle orifices (cf. accompanying FIG. 1) in the manner described therein. The nozzle orifice arrangement and the overlap angle of the two ends of the sides correspond to the particulars from Example 9 so that the air flow angle between the centre of the spinning duct and the profiling nozzle opening is again 90° (cf. accompanying FIG. 2). In contrast to Example 9, the width of the sides of the profiling nozzle is 0.10 mm instead of 0.06 mm and the area of the nozzle orifices is 1.33 $mm^2$. The other spinning and after-treatment conditions correspond to the particulars in Example 9. The porous hollow fibers, which have a final titer of 6.7 dtex, have a water-retention capacity of 45.3%. The cross-sections of the sample fibers are completely uniform and round, the cavity portion is again 50% of the total cross-sectional area.

(b) A proportion of the spinning solution from Example 15 is dry spun from a 36 orifice nozzle having loop-shaped nozzle orifices (cf. accompanying FIG. 1) in the manner described in Example 9. The nozzle orifice arrangement, overlap angle of the ends of the sides and air flow angle again correspond to the particulars from Example 9. The width of the sides of the profiling nozzle is 0.12 mm and the area of the nozzle orifice is 0.16 $mm^2$. The spinning and after-treatment conditions correspond to the data from Example 9. Hollow fibers are formed, but they are not uniform in shape. In addition to completely round porous hollow fibers, loop-shaped cross-sectional shapes and collapsed cross-sectional shapes in the manner of tubes having smaller cavity volumes are obtained. The water-retention capacity is 25.1%.

(c) A further proportion of the spinning solution from Example 15 is dry spun from a 36 orifice nozzle having loop-shaped nozzle orifices (cf. accompanying FIG. 1) in the manner described in Example 9. The nozzle orifice arrangement, overlap angle and air flow angle correspond to the particulars from Example 9. The width of the sides of the profiling nozzle is 0.15 mm and the area of the nozzle orifices is 0.20 $mm^2$. The spinning and after-treatment conditions correspond to the data from Example 9. Hollow fibers are no longer obtained. The profiled shape merges and forms compact, irregular oval to irregular cross-sectional structures. The water-retention capacity is 8.3%.

We claim:

1. A process for the production of hollow acrylonitrile fibers and filaments, comprising spinning solutions of filamentforming synthetic polymers through a nozzle having loop-shaped nozzle orifices by a dry spinning process, the solution having a viscosity equivalent to at least 120 falling ball seconds, measured at 80° C., or at least 75 falling ball seconds, measured at 100° C., wherein the nozzle orifice area of the profiling nozzle is smaller than 0.2 $mm^2$ and the maximum width of the sides of the loop-shaped nozzle is 0.1 mm and the overlap between the two ends of the sides of the loop-shaped nozzle forms an angle of from 10° to 30° measured from the center of the nozzle and wherein the spinning air acts on the filaments in a transverse direction to the filament take-off and the air direction forms an angle of from 80° to 100° with a straight line passing through an opening between the sides.

2. A process according to claim 1, wherein the area of the nozzle orifices is less than 0.1 $mm^2$ and the width of the sides is from 0.02 to 0.06 mm.

3. A process according to claim 1, wherein the spinning solution contains a non-solvent for the polymer which is miscible within wide limits with a spinning solvent.

4. A process according to claim 3, wherein said non-solvent is selected from the group consisting of water, glycerin, monoethylene glycol, tetraethylene glycol and sugar.

5. A process according to claim 1, wherein the viscosity of the spinning solution, measured at 80° C. is the equivalent to from 120 to 300 falling ball seconds and, measured at 100° C., to form 75 to 300 falling ball seconds.

6. A process according to claim 1, wherein the overlap between the two ends of the sides forms an angle of 20° and the air direction forms an angle of 90° with a straight line passing through the opening between the sides.

7. A process according to claim 4, wherein said solution is formed from a suspension of polyacrylonitrile and dimethylformamide with a water content of between about 2 and about 10 weight %, based on total suspension.

8. A process according to claim 4, wherein said solution is formed from a suspension comprising polyacrylonitrile, dimethylformamide and at least 5 weight % monoethylene glycol.

9. A process according to claim 1, wherein said solution comprises polyacrylonitrile and a spinning solvent selected from the group consisting of dimethylformamide, dimethylacetamide, dimethylsulphoxide, ethylene carbonate and N-methylpyrrolidone.

* * * * *